United States Patent [19]

Saunders

[11] 4,257,529

[45] Mar. 24, 1981

[54] EASY-OPEN RETAINED TAB STRUCTURE FOR BEVERAGE CAN

[75] Inventor: William T. Saunders, Weirton, W. Va.

[73] Assignee: National Steel Corporation, Pittsburgh, Pa.

[21] Appl. No.: 29,345

[22] Filed: Apr. 12, 1979

[51] Int. Cl.[3] ..... B65D 41/32

[52] U.S. Cl. ..... 220/269

[58] Field of Search ..... 220/266–273

[56] References Cited

U.S. PATENT DOCUMENTS

| | | | |
|---|---|---|---|
| 3,326,406 | 6/1967 | Brown | 220/269 |
| 3,485,410 | 12/1969 | Boik | 220/271 |
| 3,744,667 | 7/1973 | Fraze et al. | 220/269 |
| 3,838,788 | 10/1974 | Stargell | 220/271 |
| 3,967,753 | 7/1976 | Cudzik | 220/269 |

*Primary Examiner*—George T. Hall

*Attorney, Agent, or Firm*—Shanley, O'Neil and Baker

[57] ABSTRACT

A sheet metal container provided with easy-open, retained-tab, pour-feature opening structure is disclosed. An elongated tab opener is positioned with its longitudinal axis in substantially right-angled relationship to the longitudinal axis of an elongated scored tab to be moved out of the plane of the container wall panel. The tab opener is secured to the scored tab portion by a unitary rivet. Class 1 lever action, with high mechanical advantage due to location of the rivet near the working end of the tab opener which overlays the starting portion of the scoreline, provides ease of opening sheet metal containers including flat rolled steel containers. Either a lanced tab opener or a vent scoreline in the scored movable tab can be used to eliminate back tension in the sheet metal which ordinarily would oppose lifting of the handle end of the tab opener as Class 1 lever action is initiated. A triple-scoreline concept enables a reduction of residual scoreline metal at a primary scoreline and prevents random movement of score metal by placement of secondary scorelines adjacent to the primary scoreline.

5 Claims, 10 Drawing Figures

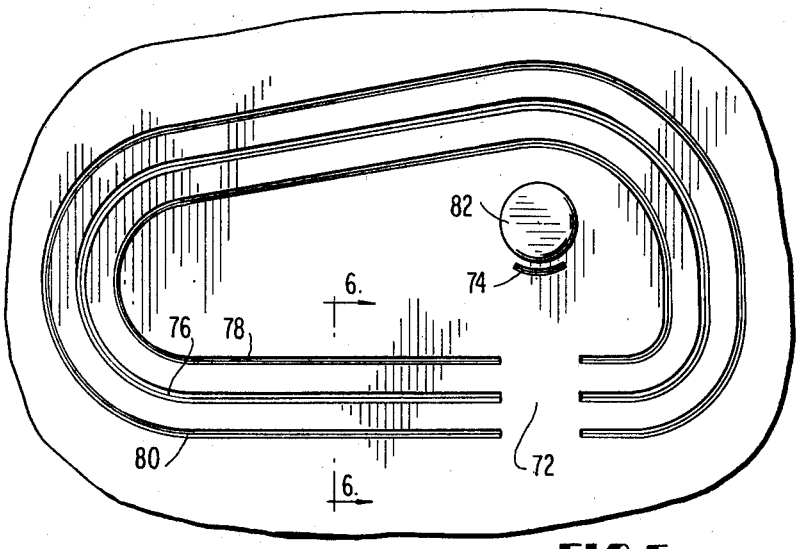
FIG. 5
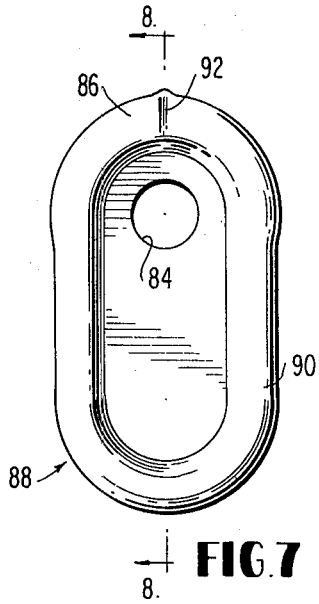
FIG. 7
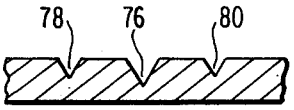
FIG. 6
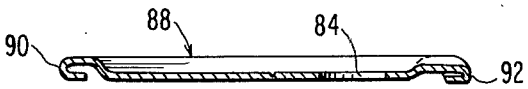
FIG. 8
FIG. 9
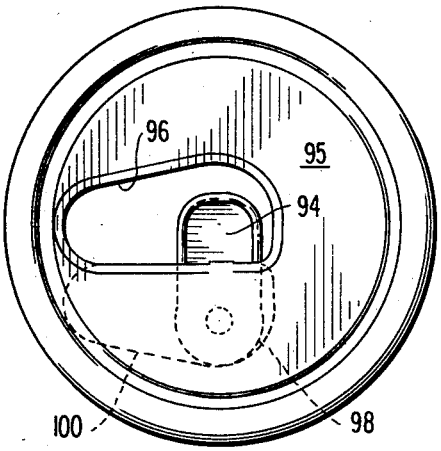
FIG. 10
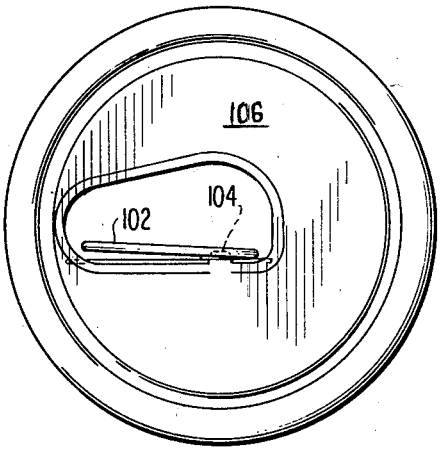

EASY-OPEN RETAINED TAB STRUCTURE FOR BEVERAGE CAN

This invention relates to easy-open, pour-feature structure for sheet metal containers in which a scored tab portion and an integral opener are retained with the container after opening.

The class 2 lever action "flip-top" opener as developed and used commercially for beverage containers provided ease of opening but had the disadvantage of increasing litter since the removed tab portion was severed completely from the container and frequently separately discarded. Because of this disadvantage, a need developed for tab opener structure which would be retained by the container. In general, the retained tab structures which developed were more difficult to open than the standard "flip-top" beverage containers and were of increased complexity in structure and manufacture. Further, the retained-tab structure being used commercially requires a dual motion, one to pen the container and one to move the tab handle out of the way of the opening.

The present invention eliminates the complexity of the proposed structures and the dual-motion requirements of the commercial retainer tab structure by providing a simplified structure which is easy to open because of increased mechanical advantage.

These and other contributions and advantages of the present invention are considered in more detail in the comparison to the commercial structure and added description of the invention as shown in the accompanying drawings.

In these drawings:

FIG. 5 is an expanded plan view of a portion of the embodiment of FIG. 3 showing the scoreline in more detail and including a vent scoreline which supplants use of a lanced tab;

FIG. 6 is a cross-sectional view taken along the lines 6—6 of FIG. 5;

FIG. 7 is an enlarged plan view of a tab opener for use with the vent scoreline embodiment of FIG. 5;

FIG. 8 is a cross-sectional view of the tab opener of FIG. 7 taken along the lines 8—8;

FIG. 9 is a plan view of a container lid embodying the invention in the open position; and FIG. 10 is a plan view of a container lid embodying the invention in the open position with the tab handle in another position from that shown in FIG. 9.

Figure 1:
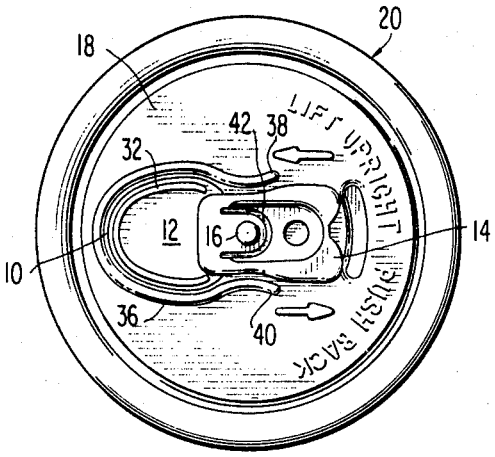
FIG. 1 PRIOR ART
FIG. 1 is a top plan view of the commercially utilized pour-feature easy-open retainer tab structure.
Figure 2:
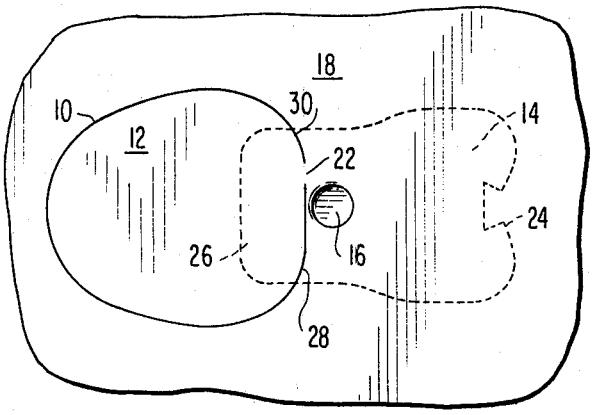
FIG. 2 PRIOR ART
FIG. 2 is a schematic plan view, from internally of the container, showing interrelationship of the scoreline, tab handle, and rivet of the commercial structure of FIG. 1.

In the prior art commercially-used retained tab structure of FIGS. 1 and 2, scoreline 10 outlines a movable tab portion 12. A tap opener 14 is secured by rivet head 16 to the remainder of the sheet metal panel wall 18 of the container lid 20. The tab defining scoreline is not closed about the periphery of the tab in order to leave hinge metal portions such as 22 for retaining the tab 12 and opener 14 on the remainder of the panel wall 18 after opening; hinge metal can be left between ends of the scoreline at either side of the rivet.

Lifting handle end 24 of the tab opener 14 causes opener 14 to pivot vertically about rivet 16 providing a lever action with rivet 16 as the fulcrum. Opening force is applied within tab 12, at a location spaced from scoreline 10, by working end 26 of the tab opener 14. Opening is initiated at locations 28 and 30 which are spaced from the working end 26; hinge metal can be left along the scoreline at either side of the rivet toward locations 28 and 30.

Intiating opening at a location spaced toward the fulcrum (rivet 16) of the lever (tab opener 14) from where the force is applied by working end 26 results in an inherent loss of mechanical advantage which increases the force required to initiate opening with this structure. Also, because of this arrangement, stiffening of the tab 12 is required to enable continued opening. As shown in FIGS. 1 and 2, a strengthening profile rib 32, which follows the inner periphery of tab 14, is generally used along with other profile contouring to help add required longitudinal stiffness to such movable tab.

Further, a strengthening profile rib 36 is positioned externally of the periphery of the tab 12 and extends to distal ends 38 and 40 in order to help stiffen the sheet metal in the surrounding area to help facilitate initial breakage and continued opening. Both such profiling requirements, internally and externally of the scoreline 10, can be detrimental to scoreline integrity.

To facilitate opening, the tab opener 14 is lanced at line 42 with a U-shpaed configuration circumscribing rivet 16 in order to avoid back tension in the sheet metal near the unitary rivet upon pivoting.

As indicated by the directions scribed on the lid of FIG. 1, two separate motions are required for opening; a lifting upright with swinging over of the handle in an arc in order to open the container and then lifting again and pushing back of the handle in an arc in order to remove the handle from blocking the opening. The tab portion 12 is held to the remaining panel portion 18 of the sheet metal by hinge metal 22. The tab opener 14 is separably held to the remainder of the sheet metal by rivet 16 which is positioned contiguous to the scoreline.

Significant contributions and advantages of the present invention include: ease of opening because of a configuration and arrangement in which the initial scoreline breaking force is applied directly where severance is to be initiated which maximizes Class 2 lever action mechanical advantage, ease of continued opening because of the arrangement, optional use of either a lanced tab or vent scoreline, holding the tab opener to the container with a unitary rivet located within the removable tab portion, hinge line metal which is less subject to embrittlement with flexing, a single arc movement for opening in which the tab opener comes to rest out of the way of the opening, elimination of rib profiling contiguous to the scoreline which can be detrimental to scoreline residual metal strength, and an improved scoreline concept which increases the depth of scoring which can be safely permitted.

In contrast to the commercially used retainer tab structure of FIGS. 1 and 2, an elongated tab opener 50 (FIGS. 3 and 4) is positioned with its longitudinal axis in substantially right-angled relationship to the longitudinal axis of an elongated tab portion 52 which is to be moved from its co-planar relationship with the remainder of panel 54. Linearly extended scoreline 56 defines the elongated tab portion 52. Working end 58 of tab opener 50 is aligned with, i.e. positioned directly over, a section 60 of scoreline 56 where severing is initiated so that a force moving handle end 62 of tab opener 50 away from the container applies opening force directly to that portion of the scoreline to be severed. Upon initial rupture, the sheet metal tears easily along the scoreline 56, in both directions from initially severed portion 60, with continued lifting movement of handle end 62 of tab opener 50.

Protrusions 64 and 66 keep the working end 58 of tab 50 aligned with the rupture starting section 60. Finger well 68 provides access for applying a lifting force to handle end 69 of tab opener 50. "Smile" line contours 67, 69 may be positioned in spaced relationship on each side of the elongated opening to help provide lip protection.

It should be noted that a single movement in one direction only, along the arc through which handle end 62 is swung, is required to complete the opening. The tab handle need not be swung backward out of the way of the opening as in the prior art structure of FIGS. 1 and 2.

In the opening procedure of the present invention, tab opener 50 pivots about unitary rivet means 70 as the handle end 62 is moved away from the container initiating breakage of the scoreline 56 at starting section 60. As the movement of handle end 62 of opener 50 continues in an arc about rivet means 70, residual metal of the scoreline 56 readily tears about the tab portion 52 except for a hinge portion of sheet metal which is non-scored and initially below the tab handle; such hinge metal 72 is better shown in FIG. 4.

Figure 3:
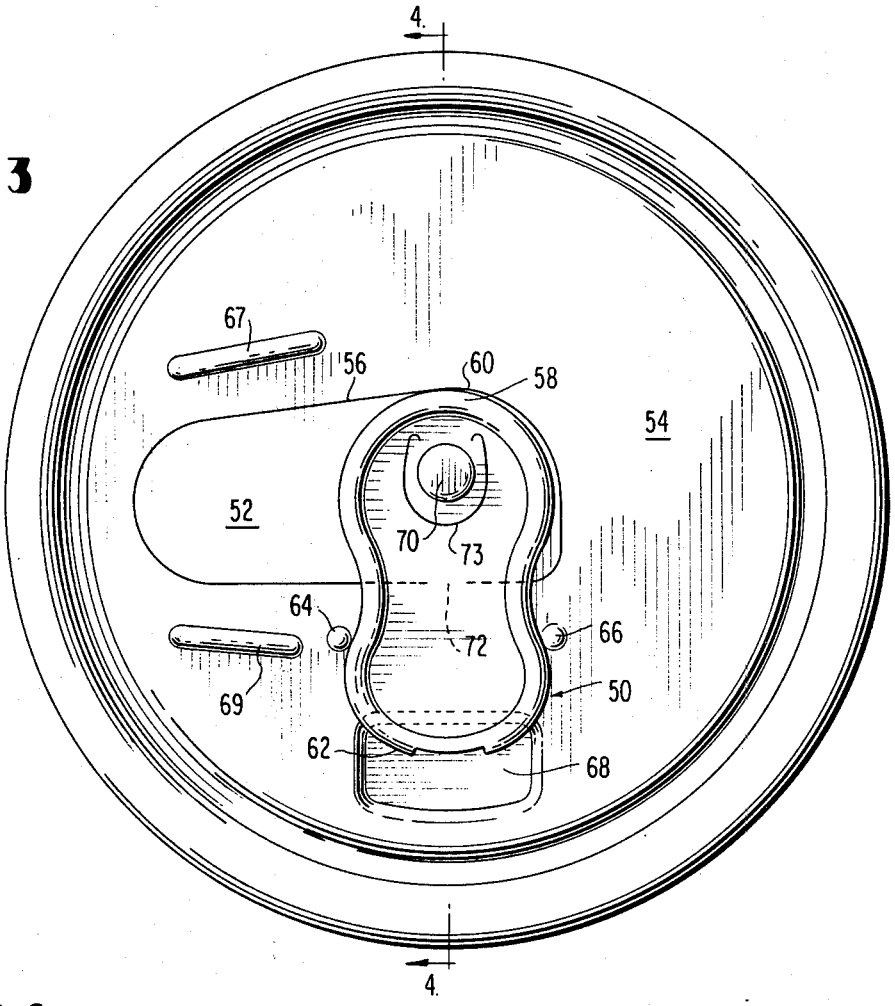
FIG. 3 is a top plan view of the easy-open retainer tab pour feature structure of the present invention.
Figure 4:
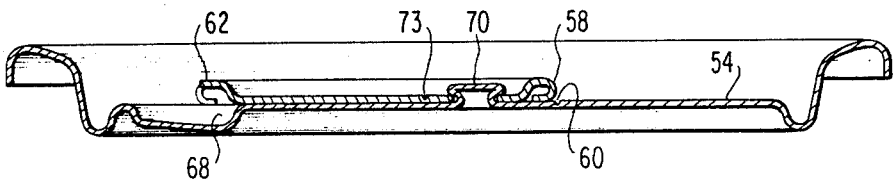
FIG. 4 is a cross-sectional view of the embodiment of FIG. 3 taken along the line 4—4.

In the embodiment of FIG. 3, the tab opener 50 is lanced with a U-shaped cut line 73 circumscribing the rivet means 70; lancing of the tab opener is one option available with the invention; another option available with the invention, for relieving the back tension in the sheet metal when raising the handle end of the tab opener 50, is to provide a vent scoreline 74 positioned contiguous to the rivet as shown in FIG. 5. Vent scoreline 74 is ruptured by class 2 lever action upon lifting of the handle end of a tab opener which is not lanced.

In accordance with the teachings of the invention, the rivet means 70 is located within the movable portion of the container wall which helps provide mechanical advantage not available with the prior art structure of FIGS. 1 and 2 in which the output arm of the tab opener must extend from rivet means located in the remaining panel portion across the scoreline configuration to a location spaced inwardly from the scoreline periphery.

In addition to hinge metal 72 not being scored, as shown in FIG. 5, it is not stressed in any way by formation of the rivet, that is the sheet metal involved in formation of the rivet means 70 is spaced from the hinge metal 72. As a result, hinge metal 72 is relatively soft; such sheet metal is substantially in an annealed condition as originally provided and therefore not as subject to brittle hardening and rupture with flexing of the tab opener. Also, no reinforcing ribbing of the movable tab portion is required which helps maintain the integrity of scorelines and rivet structure.

As shown in FIG. 5, a "triple score" concept is taught by the invention; this concept controls movement of metal during scoring and enables deeper, more uniform scoring of the primary scoreline defining the movable tab portion while reducing the possibility of accidental rupture during forming. The enlarged cross sectional view of FIG. 6 shows relative depth of the three scorelines provided in the triple score concept. Primary scoreline 76 has the deepest configuration; e.g. residual metal can be selected to be as low as 0.002 inch in a flat rolled steel container panel. Inner 78 and outer 80 secondary scorelines, which functionally can be referred to as anti-fracture scorelines, are substantially co-extensive with and uniformly spaced in close proximity about the primary scoreline 76. Utilizing flat rolled steel, secondary scorelines 78, 80 are selectively scored to provide residual metal of about 0.002 inch greater thickness than that of the primary scoreline.

Deep scoring of primary scoreline 76 while maintaining the integrity of this main scoreline is facilitated by the secondary scorelines 78, 80. In scoring sheet metal to outline an opening, the metal from within the scoreline must be moved substantially laterally. Use of a deep scoreline such as 76 would, without the contiguous inner and outer secondary scorelines 78 and 80, cause random movement of metal and random buckling of the tab portion being outlined as well as the remaining panel portion. Such movements of metal would require a greater thickness of residual metal throughout the length of the primary scoreline. Placement of the secondary scorelines, as indicated, absorbs such movement of metal and relieves tension on the main scoreline. The control of metal movement provided by use of the triple score concept enables controlled selection of residual metal thickness along the length of primary scoreline 76. For example, residual metal at starting section 60 can safely be selected to be less than residual metal in the remainder of the primary scoreline. Also, the metal between the primary scoreline 76 and the outer secondary scoreline 80 is raised above the contour of the remainder of the panel and provides lip protection from the edge of the opening.

The steps in forming a unitary rivet are well known from prior practice. A protrusion, referred to as a rivet button, is formed in the flat rolled sheet metal. A tab opener with an aperture for receiving the rivet button is placed on the container. Flattening of the rivet button forms a rivet head in overlaying relationship to the aperture in a tab handle. Utilizing steel, a small rivet button of about one-eighth ($\frac{1}{8}$) inch diameter can be utilized and forming the rivet head need only increase that diameter about one thirty-secondth (1/32) of an inch in order to provide sufficient holding force for the tab opener.

As shown in the expanded view of FIG. 5, such a rivet button 82 is positioned more closely to the tab scoreline and, in turn, the tab opener aperture 84 can be positioned closer to working end 86 of tab opener 88 as shown in FIG. 7.

Opening of a container about the primary scoreline is initiated by Class 1 lever action upon movement of the working end of the tab opener away from the container. Locating the rivet near the working end of the tab opener, as well as near the scoreline to be severed initially, provides increased mechanical advantage lever action over that available in the structure of FIGS. 1 and 2. For example, spacing between the rivet and the scoreline or the working end of the tab opener can be approximately three-eighths inch, or less, in the pour feature opening taught by the invention for beverage containers. The remainder of the handle length from the rivet to the work input end of the tab opener can be approximately seven-eighths inch, or greater. A mechanical advantage between two and four to one can be readily accomplished because of the placement arrangements made possible by the invention.

As shown in FIGS. 7 and 8, the tab opener 88 includes folded-over metal 90 which extends around the periphery of the tab opener adding longitudinal strength to the tab opener. Working end 86 can include contoured portion 92, directed toward the scoreline, to localize opening force. Use of zinc coated flat rolled steel, such as electrozinc plated steel, provides protection for the cut edge of the sheet metal which is folded-over metal. Because of the sacrificial nature of the zinc coating, repair of such sheet metal edge is not required.

As shown in FIG. 9, upon completion of a 180° arc, tab handle 94 is positioned near or substantially in the plane of the remaining panel 95. Working end 98 and tab portion 100 (both shown in dotted lines) are within the container approaching parallel relationship with the remainder of the panel 95.

In another method of opening as shown in FIG. 10, after severance and hinging action through a 90° arc, tab opener 102 can be rotated about rivet 104 to a position within the container in a plane substantially perpendicular to remaining panel 106.

With the present teachings, the invention is readily applicable to flat rolled steel to provide ease of opening; representative gages and dimensions for flat rolled steel have been set forth. The invention is also applicable to other sheet metals for beverge cans such as aluminum; when aluminum is used, the sheet metal thickness gage should be increased approximately 15% and the scoreline residual metal can be increased. The starting gage for a beverage conainer lid, considering both steel and aluminum, can be between about 0.008 inch and about 0.015 inch.

Other design or configurational aspects than shown in the accompanying drawings can be used. Other structures can also be used, e.g. a single protrusion coacting with an aperture in the panel portion of the tab handle can be used to prevent rotation of the handle prior to opening. Also, other dimensions and thickness gages can be substituted for the values presented above. Such departures from the above description are made possible in the light of the above teachings while utilizing the principles of the invention. Therefore, in determining the scope of the present invention, reference should be made to the accompanying claims.

I claim:

1. Sheet metal container wall with easy-open, retained tab, pour-feature opening structure comprising a sheet metal container wall panel, linearly extended scoreline means in such wall panel with residual metal of a thickness less than that of the sheet metal container wall panel, such scoreline means outlining a movable wall portion to be moved out of conforming contour with the remainder of the sheet metal wall panel, such movable wall portion having an elongated configuration about a longitudinal axis to define an elongated pour-feature opening in such wall panel, such scoreline means circumscribing a major portion of such elongated pour-feature opening with non-scored sheet metal between terminating ends of the linearly extended scoreline means comprising a hinge means for retaining the movable wall tab portion to the remainder of the panel wall upon opening of the container, the linearly extended scoreline means including a primary scoreline which is ruptured to form such elongated opening, such primary scoreline penetrating the sheet metal container wall to provide predetermined thickness residual metal, and secondary scoreline means being adjacent the primary scoreline defining the elongated opening, such secondary scoreline means being substantially uniformly spaced from the primary scoreline, such secondary scoreline means penetrating the sheet metal to leave residual metal or substantially greater thickness than the residual metal of the primary scoreline, such secondary scoreline means being substantially co-extensive with the primary scoreline and comprising a secondary scoreline located in the movable wall portion, and a secondary scoreline in the remainder of the sheet metal wall panel, an elongated tab opener having a working end and a handle end at its opposite longitudinal ends, unitary rivet means for securing the tab opener to the movable wall tab portion contiguous to one longitudinal end of the movable wall portion, with the longitudinal axis of the tab opener in substantially right angled relationship to the longitudinal axis of the movable wall portion and with the working end of the tab opener contiguous to and aligned with a portion of the primary scoreline which is to be severed initially and the handle end of the tab opener being in overlaying relationship to the non-scored sheet metal between terminating ends of the linearly extended scoreline means which comprise such hinge means, such secondary scoreline within the movable wall portion being spaced from the primary scoreline toward the unitary rivet means, aperture means in the tab opener for receiving metal for forming the unitary rivet means, such unitary rivet means including a rivet head means securing the tab opener to the movable tab portion, the aperture for receiving such rivet head being located along the longitudinal axis of the elongated tab opener contiguous to the working end of the elongated tab opener so as to align the working end of the tab opener with such portion of the scoreline means which is to be severed initially, such residual metal of the scoreline means being severed by Class 1 lever action by movement of the handle end of the tab opener through a 90° arc in a direction away from the container wall panel causing severance of the scoreline and moving the movable wall tab portion internally of the container into a plane substantially perpendicular to the remainder of the panel wall to provide such elongated opening with the movable wall tab portion being retained by the remainder of the wall panel and the tab opener being retained by the movable tab portion, the tab opener being positioned to be substantially free of protrusions above the contour of the remainder of the sheet metal wall panel by rotation of the elongated tab opener about the unitary rivet means to a position within the container substantially parallel to the plane of the movable wall portion.

2. The structure of claim 1 in which the tab opener comprises sheet metal and includes a lanced portion partially circumscribing the rivet head portion of the unitary rivet means permitting the handle end of the tab opener to swing in arcuate relationship about the rivet means to move the working end of the tab opener toward the sheet metal panel and initiate opening.

3. The structure of claim 1 in which the movable wall tab portion includes a vent scoreline with residual metal of a thickness less than that of the sheet metal panel, such vent scoreline being positioned adjacent to the unitary rivet between such rivet and the hinge means, such vent scoreline being ruptured upon movement of the handle end of the tab opener in a direction away from the remainder of the wall portion to facilitate pivoting of the tab opener about the rivet to initiate opening.

4. The structure of claim 1 in which the sheet metal comprises flat rolled steel and the residual metal of the primary scoreline has a thickness as low as 0.002 inch and the secondary scoreline means has residual metal of about 0.002 inch greater thickness.

5. The structure of claim 1 in which the tab opener is strengthened by folding over a portion of the sheet metal about its periphery, such tab opener comprising zinc-coated flat rolled steel.

* * * * *

UNITED STATES PATENT AND TRADEMARK OFFICE

CERTIFICATE OF CORRECTION

PATENT NO. : 4,257,529

DATED : March 24, 1981

INVENTOR(S) : William T. Saunders

It is certified that error appears in the above-identified patent and that said Letters Patent are hereby corrected as shown below:

Column 1, line 21, "pen" should be --open--.

Column 2, line 29, "U-shpaed" should be --U-shaped--;
line 46, "Class 2" should be --Class 1--.

Column 6, line 9, "or" should be --of--.

Signed and Sealed this

*Eleventh* Day of *August 1981*

[SEAL]

*Attest:*

GERALD J. MOSSINGHOFF

*Attesting Officer* *Commissioner of Patents and Trademarks*